US006767156B1

(12) United States Patent
Larsson

(10) Patent No.: US 6,767,156 B1
(45) Date of Patent: Jul. 27, 2004

(54) THREAD JOINT AND THREADED COMPONENTS FOR PERCUSSIVE DRILLING COMPONENTS

(75) Inventor: Kenneth Larsson, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/721,984

(22) Filed: Nov. 27, 2000

(30) Foreign Application Priority Data

Nov. 26, 1999 (SE) ..... 9904324

(51) Int. Cl.[7] ..... F16D 1/00; F16L 15/00
(52) U.S. Cl. ..... 403/343
(58) Field of Search ..... 464/18–20; 403/1, 403/40, 62, 296, 368, 370, 374.3, 299, 343

(56) References Cited

U.S. PATENT DOCUMENTS 1,733,392 A 10/1929 Barra
3,822,952 A 7/1974 Johansson et al.
4,022,287 A 5/1977 Lundstrom et al.
4,332,502 A 6/1982 Wormald et al.
4,398,898 A * 8/1983 Odom ..... 464/20
4,441,565 A 4/1984 Liljekvist
4,687,368 A 8/1987 Eklof et al.
4,834,193 A * 5/1989 Leitko, Jr. et al. ..... 175/19
4,968,068 A 11/1990 Larsson

FOREIGN PATENT DOCUMENTS

DE 512954 11/1930
DE 29614490 11/1996

* cited by examiner

*Primary Examiner*—Lynne H. Browne
*Assistant Examiner*—Ryan M. Flandro
(74) *Attorney, Agent, or Firm*—Burns, Doane, Swecker & Mathis, L.L.P.

(57) ABSTRACT

Two components used in a percussive drill string include a spigot and a sleeve, respectively. The spigot includes a male thread connected to a female thread of the sleeve to form a thread joint. The male and female threads are dimensioned such that axially inner and outer end areas of the female thread are in non-engagement with the male thread when the thread joint is in a tightened state. The spigot includes axially inner and outer conical guiding surfaces facing toward respective axially outer and inner conical guiding surfaces, respectively. Each conical guiding surface forms an angle with a centerline of the sleeve, the angle lying in the range 1 to 20 degrees, to prevent the spigot and the sleeve from being welded together by frictional heat during a drilling operation.

8 Claims, 4 Drawing Sheets

THREAD JOINT AND THREADED COMPONENTS FOR PERCUSSIVE DRILLING COMPONENTS

BACKGROUND OF THE INVENTION

The present invention relates to a thread joint between drill string components used in percussive rock drilling operations, and to a male threaded component and a female threaded element used in such components.

A conventional thread joint between two components in a rock drilling equipment for percussive drilling normally has male and female threads cut therein, see for example Eklof et al. U.S. Pat. No. 4,687,368 and Wormald et al. U.S. Pat. No. 4,332,502. During the production of the male thread, a blank of steel is shaped by a threading tool, the blank including an enlarged portion in which the thread is to be formed. The ends of the enlarged portion connect respectively to: (i) a clearance surface or a clearance groove of smaller diameter to receive at least parts of the threading tool, and (ii) a usually conical free end. Then the enlarged portion is provided with a thread in a conventional way, Sharp edges are formed at the thread entrance and exit due to the geometries of the clearance groove and the free end surface. Corresponding sharp edges are formed when cutting a corresponding female thread in another component. The sharp edges cause the male and female threads to damage each other foremost at the respective free end during use of the joint. The conventional thread joint has one or two axially directed support surfaces. When the known thread joint is subjected to bending forces during drilling the thread joint is subjected to bending moments which might lead to fatigue breakage in the threaded portion of the joint. It is usually the damaged male thread that limits the life span of the joint.

OBJECTS OF THE INVENTION

One object of the present invention is to provide a thread joint of the above mentioned type, for which a good life span is attained.

Another object of the present invention is to provide a thread joint of the above-mentioned type, in which the life span of the male portion is maximized.

Still another object of the present invention is to provide a thread joint of the above-mentioned type, in which the thread joint can transfer great bending moments without influencing the threads to any great extent.

Still another object of the present invention is to provide a thread joint of the above-mentioned type, in which the thread joint comprises portions that unloads the threads.

SUMMARY OF THE INVENTION

The objects of the invention are realized by a thread joint between first and second percussive drilling components. The first component includes a generally cylindrical male thread, and the second component includes a generally cylindrical female thread connected to the male thread to form the thread joint. Each of the male and female threads includes end areas where a radius of the respective thread is smallest. The spigot includes inner and outer conical guiding surfaces disposed adjacent axially inner and outer ends of the spigot. The sleeve includes axially inner and outer conical guiding surfaces disposed adjacent axially inner and outer ends of the spigot, respectively, and arranged to approach respective outer and inner guiding surfaces of the spigot when the spigot enters the sleeve in an impact direction. Each of the conical guiding surfaces of the spigot and the sleeve has a cross section diminishing in the impact direction and defining an apex angle with a center line of the thread joint. The apex angle lies in the range of 1 to 20 degrees.

Another aspect of the invention pertains to a percussive drilling component which includes a spigot having a generally cylindrical male thread formed thereon. The thread includes an axially inner end area and an axially outer free end area, where a radius of the thread is smallest as viewed in a longitudinal cross-section of the spigot. The spigot includes an axially inner conical guiding surface facing toward an axially outer free end of the spigot. The spigot also includes an outer conical guiding surface facing in the same direction as the inner conical guiding surface. The male thread is disposed between the inner and outer conical guiding surfaces. Each of the inner and outer conical guiding surfaces forms an angle with a center line of the spigot. The angle lies in the range of 1 to 20 degrees.

In still another aspect of the invention a percussive drilling component includes a sleeve having a generally cylindrical female thread. The female thread includes axially inner and outer end areas, where a radius of the thread is smallest as viewed in a longitudinal cross-section of the sleeve. The sleeve includes an axially inner conical guiding surface facing toward an axially outer free end of the sleeve. The sleeve also includes an outer conical guiding surface facing in the same direction as the inner conical guiding surface. The female thread is disposed between the inner and outer conical guiding surfaces. Each of the inner and outer conical guiding surfaces forms an angle with a center line of the sleeve. The angle lies in the range of 1 to 20 degrees.

BRIEF DESCRIPTION OF THE DRAWINGS

The objects and advantages of the invention will become apparent from the following detailed description of preferred embodiments thereof in connection with the accompanying drawing in which like numerals designate like elements, and in which.

DETAILED DESCRIPTION OF THE PREFERRED EMBODIMENTS OF THE INVENTION

Figure 1:
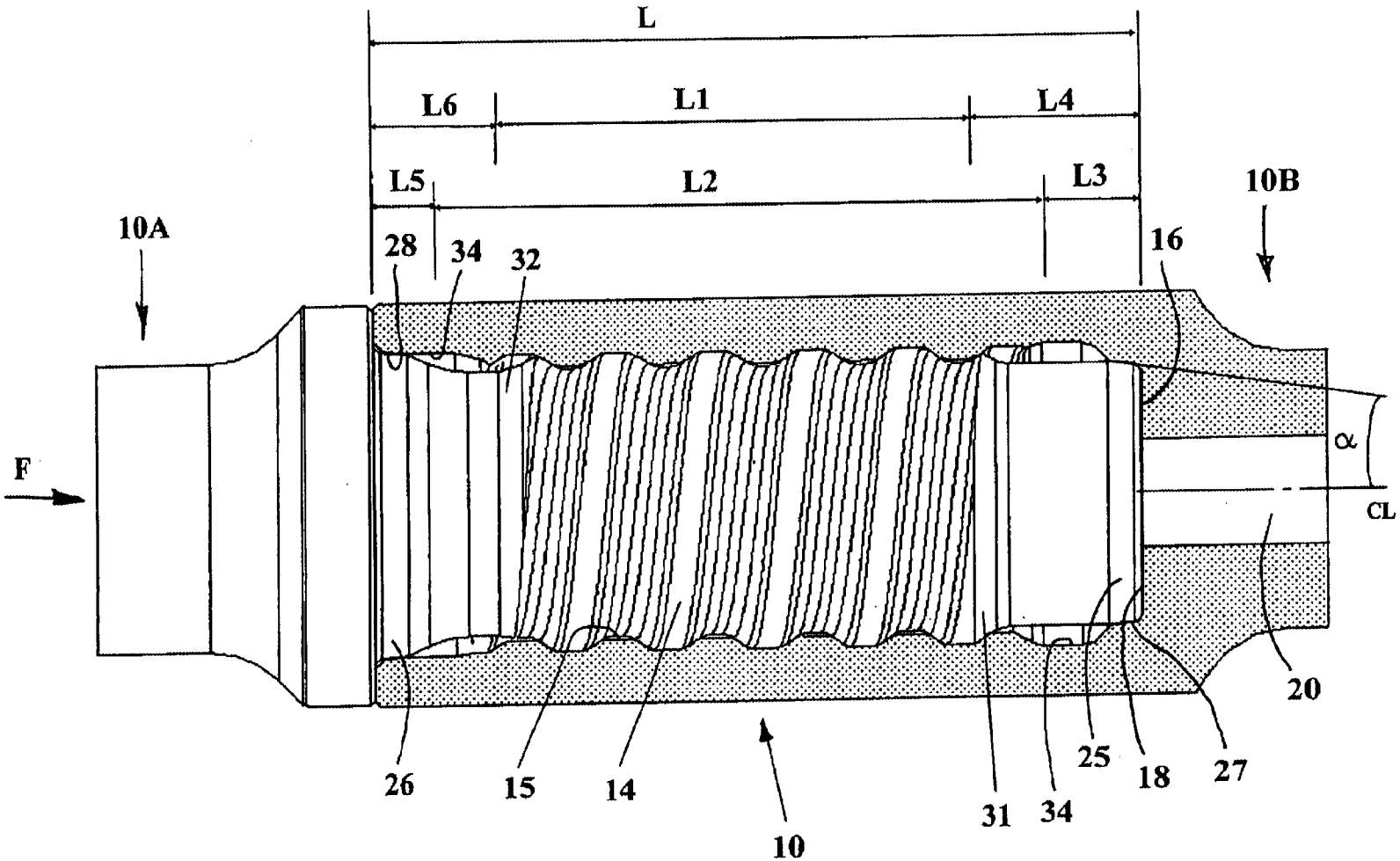
FIG. 1 shows a partly longitudinally sectioned view of a thread joint between two identical drill rod components according to the invention.

A thread joint 10 according to the present invention preferably comprises drilling components in the form of two preferably identical drill tubes or drill rods 10A, 10B used in percussive drilling. Each drill rod includes an end with a projecting spigot or male portion 12 and an opposite end with a sleeve or female portion 13. The spigot has a generally cylindrical external (male) thread 14, and the sleeve has a generally cylindrical internal (female) thread 15. Each thread 14, 15 preferably has only one entrance and one exit. When the two drill rods 10A, 10B shown in FIG. 1 are being threaded together to form the joint 10, the axially free outer end surface 16 of the male portion 12 will enter into the area surrounded by the axially free outer end surface or abutment surface 17 of the female portion. In most cases the rods must be rotated relative to each other while being forced together such that the threads can engage each other. Then the rods are further rotated until the free end surface 16 of the spigot abuts against a bottom 18 in the female portion and/or the abutment surface 17 abuts against an annular inner shoulder 19 located at the inner end of the spigot 12.

The threads 14 and 15 are conventionally designed such that when assembled, abutment between the threads arises only at certain flank portions of the respective male and female portions; contact between thread tips and thread bottoms does not occur. In Larsson U.S. Pat. No. 4,968,068, the disclosure of which is hereby incorporated by reference, a thread joint is shown in which the present invention can be utilized. The female portion 13 constitutes an integral part of the drill rod. Furthermore, the drill rod has a through-going flush channel 20, through which a flush medium, usually air and/or water, is transported.

Figure 2:
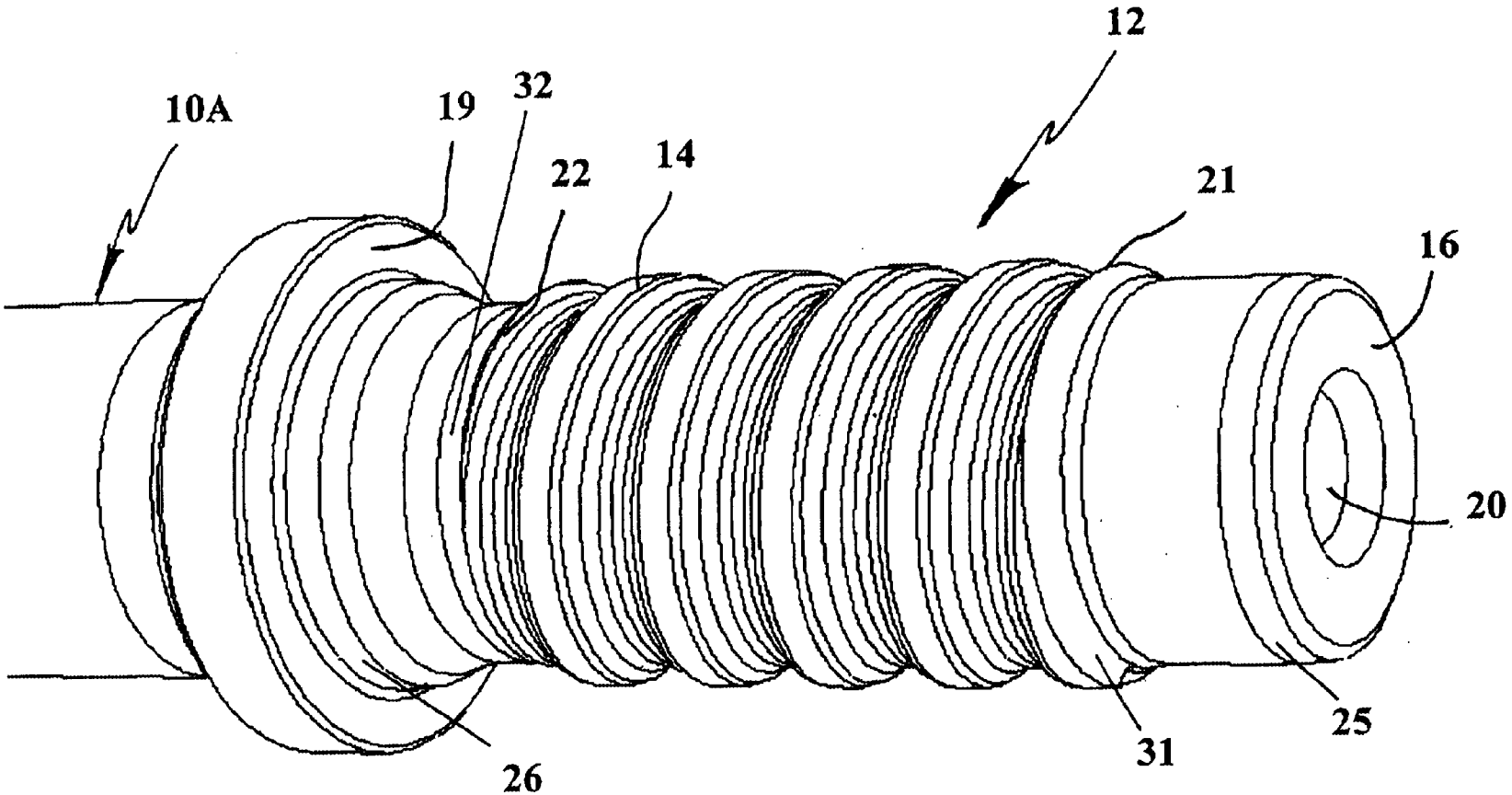
FIG. 2 shows a male portion of the thread joint according to the present invention in a perspective view.
Figure 3:
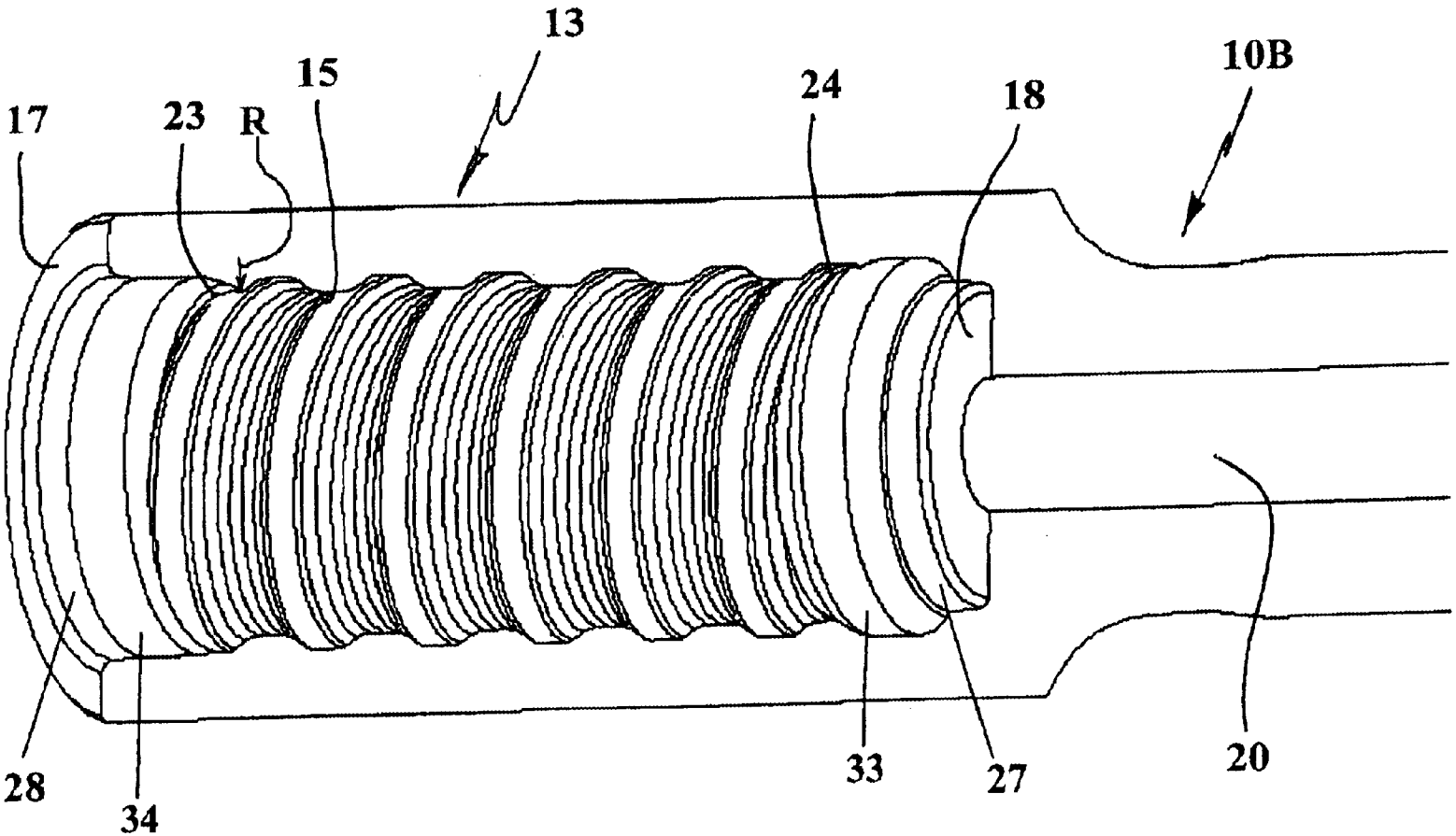
FIG. 3 shows a female portion of the thread joint in a longitudinal sectional perspective view.

The generally cylindrical external male thread 14 includes an outer thread end 21 and an inner thread end 22 (see FIG. 2). The generally cylindrical internal female thread 15 includes an outer thread end 23 and an inner thread end 24. Each thread end 21–24 includes a sharp edge due to clearances developed before the threads are cut into the components, i.e. conical clearances 31, 32 on the spigot 12 and cylindrical clearances 33, 34 on the sleeve 13. The sharp edge defines the smallest radius R of the respective thread, as shown in the longitudinal section according to FIG. 3. As pointed out earlier, those sharp edges damage the opposing thread during a percussive drilling operation. The damage to the male thread is typically more extensive, and thus the rate of deterioration of the male thread determines the useful life of the joint.

In accordance with the present invention, the male thread 14 and the female thread 15 have a mutual relationship as regards length and shape, in that neither of the thread end areas 23, 24 of the female thread 15 contacts the male thread 14 when the joint is in a tightened state. That is, both of the ends 23, 24 of the female thread are disposed at a distance from the male thread in a tightened joint, thereby reducing the rate of deterioration of the male thread. More specifically, the male thread 14 has a first axial length L1 between the thread ends 21, 22, and the female thread 15 has a second axial length L2 between the thread ends 23, 24, The length L1 is shorter than the length L2. Stated another way, the distance between the conical clearances 31, 32 of the male thread is smaller than the distance between the cylindrical clearances 33, 34 of the female thread. The distance L3 between the free end surface 16 of the spigot 12 and the inner thread end area 24 of the female thread 15 is shorter than a distance L4 between the free end surface 16 of the spigot and the outer thread end area 21 of the male thread when the joint is in a tightened state. The corresponding relationship applies for the outer end of the joint. That is, the distance L5 between the shoulder 19 of the spigot 12 and the outer thread end area 23 of the female thread 15 is shorter than a distance L6 between the shoulder 19 of the spigot and the inner thread end area 22 of the male thread when the joint is in a tightened state.

The outer and inner ends of the spigot 12 include respective conical guiding surfaces 25, 26, and inner and outer ends of the female thread 15 include conical guiding surfaces 27 and 28, respectively. The guiding surfaces 25, 26 are axially engageable with the guiding surfaces 27, 28, respectively. All cone apices of the conical guiding surfaces 25–28 are directed in the impact direction F. That is, the cross-sectional area of each of the cones diminishes in the direction F. Each conical guiding surface forms an angle $\alpha$ with the centerline CL of the joint 10. The angle $\alpha$ is in the interval of 1–20°, preferably 5°, for avoiding local welds at the support surfaces 25, 28. The gap between the cooperating conical support surfaces is less than the gap between the male thread and the female thread such to avoid radial forces on the threads. The length L1 of the male thread 14 is, at maximum, 80% of the length L of the spigot, i.e., the ratio between L and L1 is maximum 0.8 to reduce the risk for bending loads. Both end areas 21, 22 of the male thread 14 are provided at the distances L4, L6 from the ends 16, 19 of the spigot.

Since the guiding surfaces 25–28 form an angle $\alpha$ with the centerline CL, there is less likelihood of the spigot and sleeve becoming welded together by frictional heat generated during a percussion drilling operation. That is in the case where such guiding surfaces are cylindrical, rather than conical (see U.S. Pat. No. 4,332,502), considerable heat can be generated as opposing ones of the guiding surfaces rub against one another during relative axial movement created by percussion impacts applied to the drill string. Such heat might cause the opposing guiding surfaces to become welded together. However, by inclining the guiding surfaces at an angle $\alpha$, the guiding surfaces act as stops to limit relative movement of the spigot and the sleeve in one axial direction, and the guiding surfaces become separated from one another in response to relative axial movement in another direction. Thus, the amount of frictional rubbing is minimized.

Moreover, the inclining of the guiding surfaces at angle $\alpha$ enables those surfaces to hold the spigot and sleeve in a radially centered relationship when the guiding surfaces are firmly in contact with each other, to prevent relative bending between the spigot and the sleeve that could result in damage to the threads. Also, even if the guiding surfaces are slightly out of mutual contact (e.g., if the outer end surface 16 of the spigot contacts the abutment surface 18 of the sleeve before the guiding surfaces are in full contact), the guiding surfaces are located so they will contact one another during any relative bending of the spigot and sleeve to stop such bending before the radial gap between the peaks and valleys of the threads is completely diminished, in order to prevent damage to the threads.

Thus the present invention relates to a thread joint for extension of drill components for percussive top hammer drilling having axial and radial support surfaces at opposite sides of the threads that unloads the threads during bending loads.

A trapezoidal thread is shown in the embodiment but it is understood that the invention can be used in connection with all percussive rock drilling serviceable threads, such as rope threads for example.

Figure 4:
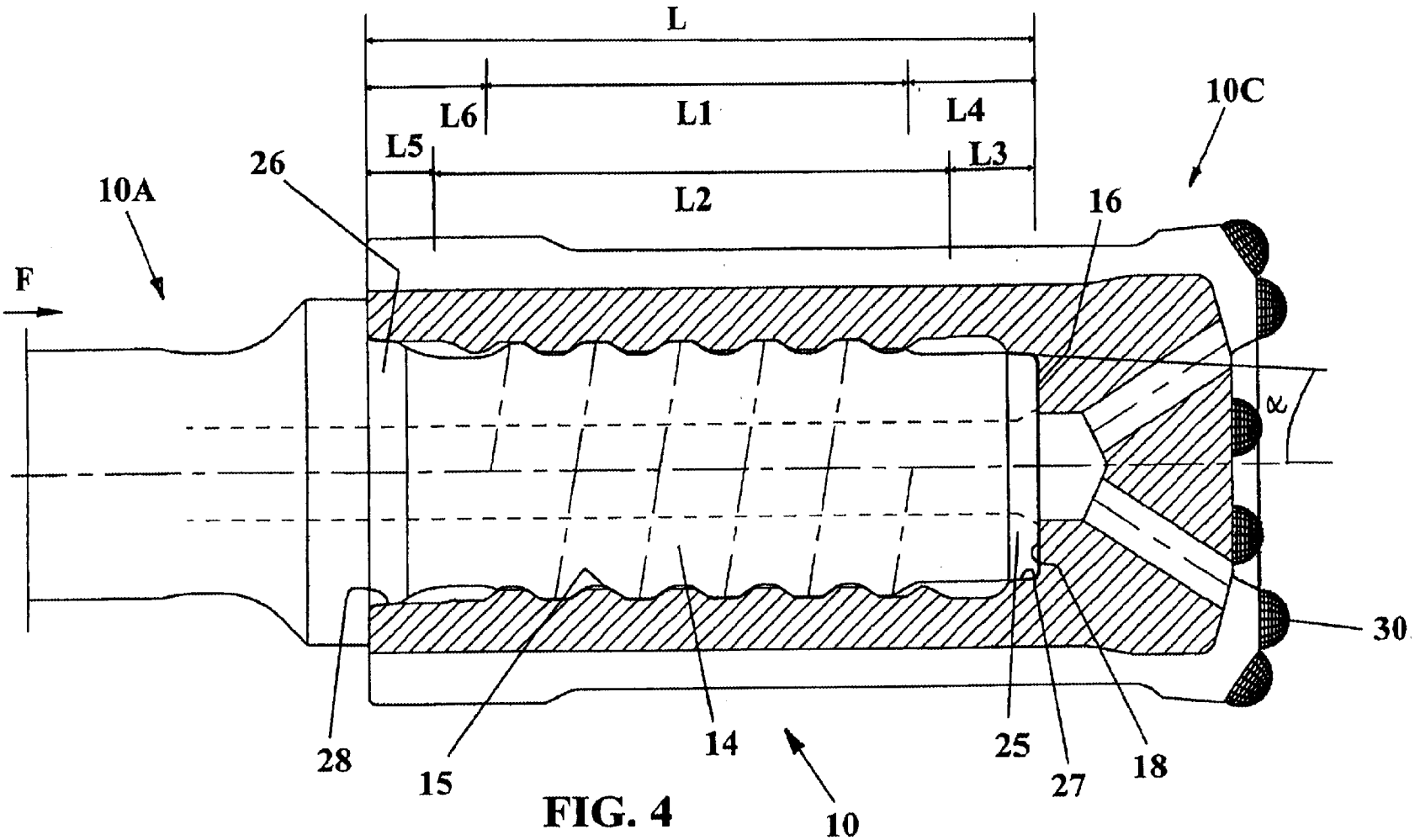
FIG. 4 shows a longitudinal section of a thread joint according to the present invention between a rock drill bit and a drill component.

Percussive drilling components that are connected by the thread joint need not be drill rods, and need not be identical. The female portion or the male portion may alternatively be integral with a drilling component in the form of a rock drill bit instead of being integral with a drill rod or a drill tube. In FIG. 4 it is shown how a rock drill bit 10C having hard metal buttons 30 used for percussive rock drilling possesses a thread joint 10 according to the present invention, with the same reference numerals as used above. The thread of the drill bit 10C is shown as being a female thread, but alternatively, that thread could be a male thread formed on a spigot of a drill bit if such a spigoted drill bit were employed.

The principles of the invention can be applied also for a thread joint disposed between drilling components in the form of a shank adapter and the drill rod as well as between two drill rods with a loose extension sleeve.

It will be appreciated that since the axially inner and outer end areas of the female thread are in non-engagement with the male thread when the joint is in a threaded state, damage to the male thread as would be caused by contact with the end areas of the female thread is minimized.

Although the present invention has been described in connection with preferred embodiments thereof, it will be appreciated by those skilled in the art that additions, modifications, substitutions an deletions not specifically described may be made without departing from the spirit and scope of the invention as defined in the appended claims.

What is claimed is:

1. In combination first and second percussive drilling components interconnected by a thread joint, the first component including a spigot having a generally cylindrical male thread, and the second component including a sleeve having a generally cylindrical female thread connected to the male thread to form the thread joint; each of the male and female threads including end areas; the spigot including inner and outer conical guiding surfaces disposed adjacent respective axially inner and outer ends of the spigot, with the male thread disposed between the inner and outer conical guiding surfaces; the sleeve including axially inner and outer conical guiding surfaces disposed adjacent axially inner and outer ends of the sleeve, respectively, with the female thread disposed between the inner and outer conical guiding surfaces of the sleeve; the inner and outer conical guiding surfaces of the sleeve disposed in mutually facing relationship with respective outer and inner guiding surfaces of the spigot; the axially inner end of the sleeve including a bottom wall extending to a location disposed farther radially inwardly than the inner conical guiding surface, each of the conical guiding surfaces of the spigot and the sleeve having a cross section diminishing in the impact direction and defining an apex angle with a centerline of the thread joint; the apex angle lying in the range of 1 to 20 degrees.

2. The thread joint according to claim 1 wherein the apex angle is 5 degrees.

3. The thread joint according to claim 1 wherein the male thread has a shorter axial length than the female thread, wherein the end areas of the female thread are in non-contacting relationship with the male thread when the thread joint is in a tightened state.

4. The thread joint according to claim 3 wherein the male thread has a first axial length; the female thread having a second axial length; the first axial length being shorter than the second axial length; the spigot including a shoulder disposed adjacent the inner end of the spigot and facing in the impact direction, wherein the inner guiding surface of the spigot is disposed between the shoulder and the outer end of the spigot; the sleeve including an inner abutment surface facing toward the outer end of the spigot; a distance between the outer end of the spigot and the inner end area of the female thread being shorter than a distance between the outer end of the spigot and the outer end area of the male thread when the joint is in a tightened state; a distance between the shoulder and the outer end area of the female thread being shorter than a distance between the shoulder and the inner end area of the male thread.

5. A percussive drilling component defining a center axis and including a spigot having an axially inner end terminating in a shoulder arranged perpendicularly to the center axis; the spigot having a generally cylindrical male thread formed thereon; the thread including an axially inner end area and an axially outer free end area, wherein a radius of the thread is smallest at the inner and outer end areas as the thread is viewed in a longitudinal cross-section of the spigot the inner end area and the outer free end area being sharper than a section of the thread disposed therebetween; the spigot including an axially inner conical guiding surface facing toward an axially outer free end of the spigot and disposed between the shoulder and the axially inner end area of the male thread; the spigot including an outer conical guiding surface facing in the same direction as the inner conical guiding surface; wherein the male thread is disposed between the inner and outer conical guiding surfaces; each of the inner and outer conical guiding surfaces having a diminishing cross section toward the axially outer free end of the spigot and forming an angle with a centerline of the spigot, the angle lying in the range of 1 to 20 degrees.

6. The component according to claim 5 wherein the angle is 5 degrees.

7. A percussive drilling component including a sleeve defining a center axis and having a generally cylindrical female thread extending axially inwardly from a location near an axially outer free end of the sleeve; the female thread including axially inner and outer end areas; the sleeve including an axially inner conical guiding surface of diminishing diameter in an axially inward direction; the sleeve including an outer conical guiding surface of diminishing diameter in an axially inward direction; the axially inner end of the sleeve including a bottom wall extending to a location disposed farther radially inwardly farther than the inner conical guiding surface, wherein the female thread is disposed axially between the inner and outer conical guiding surfaces; each of the inner and outer conical guiding surfaces forming an angle with a centerline of the sleeve, the angle lying in the range of 1 to 20 degrees.

8. The component according to claim 7 wherein the component is 5 degrees.

* * * * *